United States Patent [19]

Wittenberger

[11] 3,964,654

[45] June 22, 1976

[54] PACK STRAPS

[76] Inventor: Donald B. Wittenberger, P. O. Box 1551, Seattle, Wash. 98103

[22] Filed: July 25, 1975

[21] Appl. No.: 598,760

Related U.S. Application Data

[63] Continuation of Ser. No. 336,014, Feb. 26, 1973, abandoned.

[52] U.S. Cl. ..... 224/8 R

[51] Int. Cl.[2] ..... A45F 3/08

[58] Field of Search ..... 224/8 R, 8 A, 11, 12, 224/9, 10, 5 B, 5 W, 5 MC, 5 S, 5 N, 25 A; 9/338, 339; 84/411, 421

[56] References Cited

UNITED STATES PATENTS

| | | | |
|---|---|---|---|
| 1,871,223 | 8/1932 | Reese | 224/11 |
| 2,943,775 | 7/1960 | Mack | 224/25 A |
| 3,269,129 | 8/1966 | Zambrano | 224/25 A |
| 3,347,429 | 10/1967 | Ruth, Jr. | 224/11 |

FOREIGN PATENTS OR APPLICATIONS

| | | | |
|---|---|---|---|
| 65,643 | 12/1942 | Norway | 224/8 R |

*Primary Examiner*—Frank E. Werner
*Attorney, Agent, or Firm*—Cole & Jensen

[57] ABSTRACT

This invention relates to improvements in pack straps used to secure a pack or like carrying device to the human body, consisting of straps which run from each shoulder to the opposite side of the wearer's body.

12 Claims, 2 Drawing Figures

PACK STRAPS

This is a continuation, of application Ser. No. 336,014, filed Feb. 26, 1973, now abandoned.

SUMMARY OF THE INVENTION

Accordingly, the present invention is a pack strap apparatus useful with back packs or the like, the pack strap apparatus including first and second pack straps, which are each secured at one end thereof to the back pack near the top portion and generally near the opposite sides thereof. When the combination of the pack strap apparatus and back pack is in place on a wearer, the first and second straps extend over the shoulder of the wearer.

The pack strap apparatus also includes first and second channeling means, which are attached to opposite sides of the back pack near the bottom thereof, the first and second channeling means being arranged to extend part way toward each other around the user's waist. The pack strap apparatus also includes first and second connecting straps, the first connecting strap being associated with the first pack strap and the first channeling means, and the second connecting strap being associated with the second pack strap and the second channeling means.

The first and second connecting straps are each secured at one end thereof to their respective associated pack straps, extend downwardly therefrom to, and freely pass through, the respective associated channeling means, and further extend across the wearer's chest at an angle to the opposite pack strap such that the connecting straps cross each other in the approximate vicinity of the middle chest area of the wearer.

The position of each channeling means relative to its associated connecting strap defines first and second sections thereof, the first section of each connecting strap thus being defined as extending from one end of the connecting strap to the point there along where the connecting strap passees through the channeling means, and the second section of each connecting strap being defined as the remainder thereof.

The pack strap apparatus further includes means securing the other end of each of the connecting straps to the opposite pack strap, i.e., the other end of the first connecting strap is secured to the pack strap to which the one end of the second connecting strap is connected, and the other end of the second connecting strap is secured to that pack strap to which the one end of the first connecting strap is secured.

With such an arrangement the pack straps and the channeling means tend to be drawn toward each other with movement of the wearer, as the relative lengths of the first and second sections of each connecting strap change in response to such movement, thus maintaining the back pack in place on the wearer's back and preventing the undesirable shifting of the pack during hiking and climbing operations.

BACKGROUND OF THE INVENTION

Present back packs, both framed and frameless, are subject to physical shifting during movement of the wearer, particularly during extremes of movement such as occurs in mountain climbing operations, which require a considerable range of movement of the torso and the arms of the climber. In such situations, movement of the back pack and the attendant shifting of the pack load is highly undesirable, since it interferes with the climber's balances as well as restricting the range of arm movement. The present invention has been developed in order to overcome these general disadvantages of the prior art.

The principle object of the present invention is to reduce to and fro movement of the pack or carrying device relative to the wearer's body in order to stabilize the center of gravity of the aggregate mass of the pack-wearer and his load.

A further object is to permit the wearer to move his body, and in particular to bend at the waist in any direction and to extend his arms above his head without restraint, strain, or discomfort resulting from force exerted on the straps.

Further objects of the present invention are to provide means for manual adjustment of the length and tightness of the straps, for automatic adjustment of the relative tension betwen the various points at which the straps are anchored to the pack or carrying device as such tension changes due to body movements, to secure the pack or carrying device to the wearer's body so that it can not slip or be pulled therefrom, and reasonably convenient means to don and doff the pack or carrying device.

Further objects and advantages of the invention appear as the specification proceeds.

Figure 1:
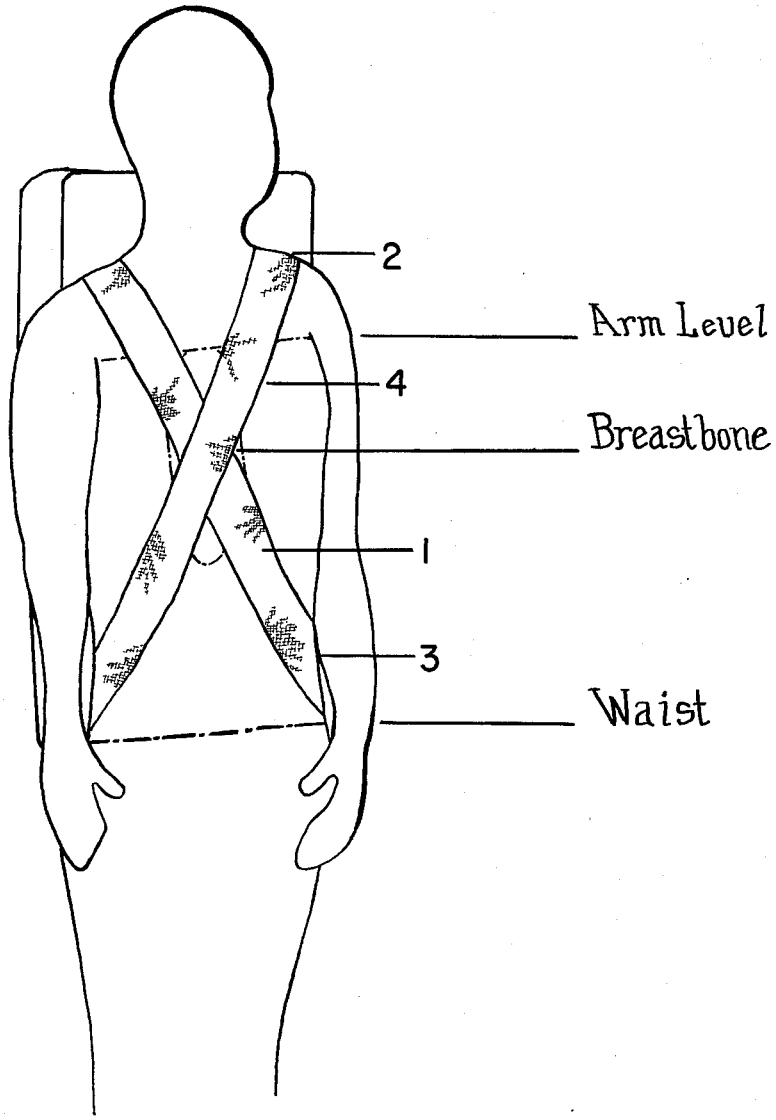
FIG. 1 is an oblique view of one embodiment of the present invention, showing a relatively simple form of the pack strap apparatus in combination with a back pack in position on a human wearer.
Figure 2:
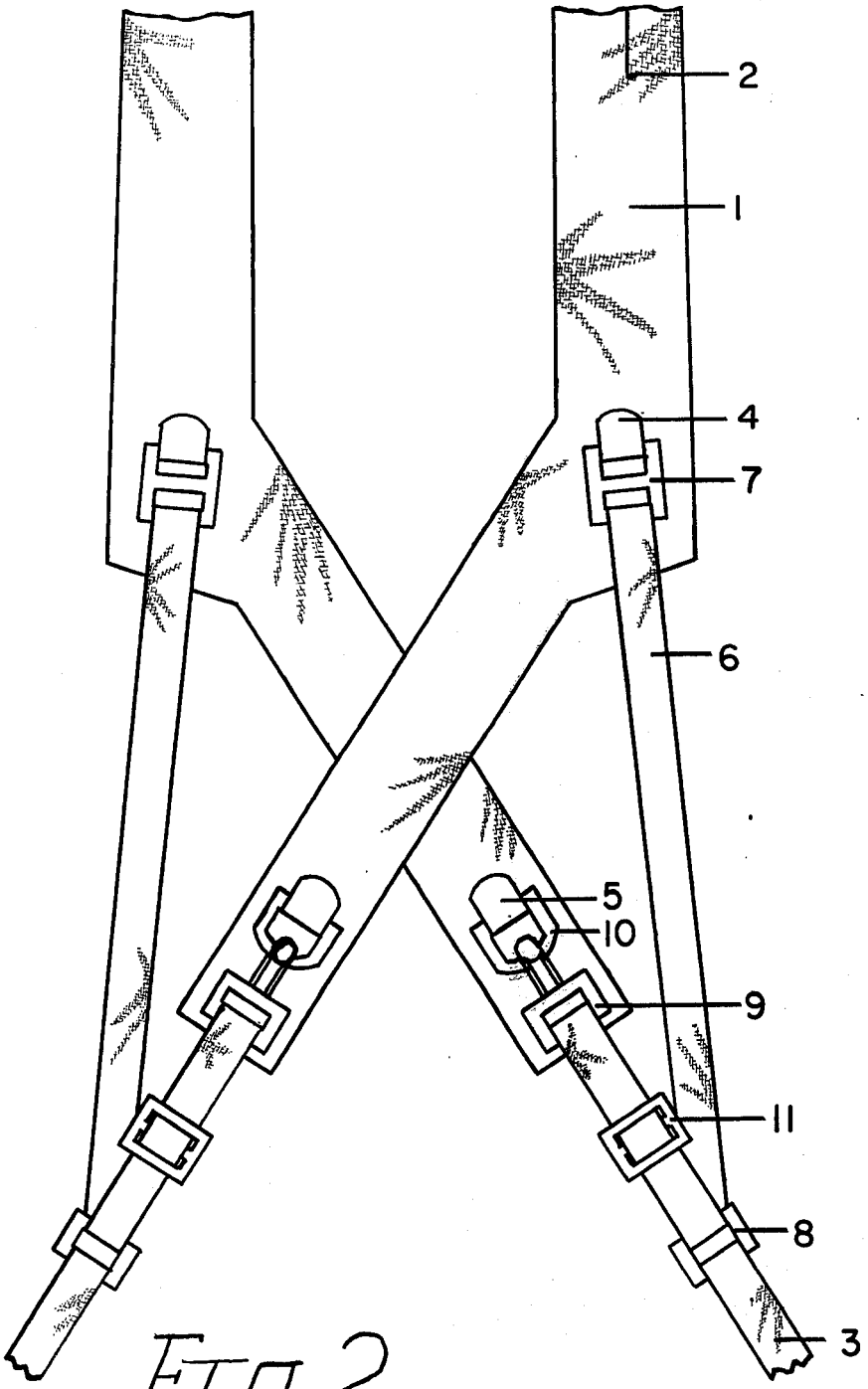
FIG. 2 is a front view of another embodiment of the pack strap apparatus of the present invention, showing a particular combination of pack straps and connecting straps and also showing the points at which the pack strap apparatus is secured to the back pack.

The present invention comprises a pack strap apparatus which, as shown in FIGS. 1 and 2, is designed to be used in combination with conventional back packs, either framed or frameless, although it is particularly suitable for use with a frameless back pack. The pack strap apparatus in use extends as shown in FIG. 1, over the chest area of the wearer and is attached to the back pack in the vicinity of the top and lower sides thereof.

Referring briefly now to FIG. 1, which shows a simplified embodiment of the present invention in position on a wearer, pack straps 1 cross the chest of the wearer and extend respectively from the top of the pack over the shoulders of wearer and across the chest to the respective lower sides of the back pack. This crossing arrangement provides the advantages of the present invention in preventing shifting of the pack on the wearer's back during movement of the wearer.

Each pack strap 1 is anchored to the pack or carrying device at a point 2 located behind and approximately level with the wearer's shoulder when the pack or carrying device is worn, and at a point 3 located at the opposite side of the wearer's torso slightly above the waist, said locations being necessary to obtain the objects of the invention without restricting breathing or movement or causing discomfort.

Referring now to FIG. 2, another embodiment of the pack strap apparatus of the present invention is shown which accomplishes the purposes of the present invention by interconnecting the frontal crossing straps in such a manner as to provide for shifting of the tension load on the pack strap apparatus between the individual straps comprising the apparatus so as to prevent movement of the pack on the wearer's back. The embodiment of FIG. 2 includes pack straps 1 which are secured at their upper ends to the top portion of the back pack (not shown) generally near opposite sides thereof at top anchor points 2—2, the pack straps 1 extending generally vertically downwardly along the wearer's chest in the direction of the wearer's waist when the pack strap apparatus is in place on the wearer. Channeling device 8—8 is connected by short straps (not shown) to the lower sides of the back pack (not shown) at bottom anchor points 3—3 in the general vicinity of the wearer's waist (not shown).

Such pack strap 1 is anchored to the bottom anchor point 3 on the pack or carrying device by means of a connecting strap 6 the functions of which are to provide means for manual and automatic adjustment and to pull the pack strap 1 away from the wearer's neck so that it does not exert pressure thereon; and in addition there may or may not be provided means to adjust the precise location of anchor points 2, 3 on the pack or carrying device. Such connecting pack strap 6 is anchored to each strap 1 by means of an adjusting device 7 such as a buckle at a point 4 located slightly below the level of the wearer's armpits, thence running to the bottom anchor point 3 on the pack or carrying device on the same side that it runs through the adjusting device 7 through a channeling device 8 such as a ring and thence to a removable attaching device 9 such as a snap hook which attaches to a receptacle device 10 such as a Dee ring anchored to the opposite pack strap 1 at a point 5 near the pack strap's end.

In order to obtain the objects of the invention, the straps should be snugly adjusted and the tension exerted on each pack strap 1 will be slightly greater at the point 4 at which the adjusting device 7 is anchored to such pack strap 1 than at the point 5 at which the receptacle device 10 is anchored to the opposite pack strap 1. An adjustable travel limiting device 11 such as a slider may be provided to stop travel of the connecting strap 6 through the channeling device 8 short of the point where that portion of the connecting strap 6 between the anchor points 3, 4 becomes so loose as to allow lateral movement of the pack or carrying device relative to the wearer's body. The manual adjustment of strap length and tightness is made at the adjusting device 7. The pack or carrying device is secured or removed by connecting or disconnecting the attaching device 9 and receptacle 10.

I claim:

1. A pack strap apparatus for use in combination with back packs or the like, comprising:

a. first and second pack strap means adapted to be secured to the back pack near the top and toward the opposite sides thereof and to extend over the shoulders of a wearer when the combination of the back pack and said pack strap apparatus is in place;

b. first and second channeling means adapted to be secured to said back pack in the vicinity of opposite sides of said back pack near the bottom thereof, such that said first and second channeling means tend to extend toward each other in the vicinity of the wearer's waist;

c. first and second connecting strap means, each having first and second ends and secured respectively, at their first ends, to said first and second pack strap means, said first and second connecting strap means extending substantially vertically downwardly from said first and second pack strap means and slidably passing through, respectively, said first and second channeling means, the positions of first and second channeling means, respectively, relative to said first and second connecting strap means defining first and second sections thereof, wherein said first section of each connecting strap extends from said first end thereof to the point there along where each connecting strap passes through its associated channeling means and wherein said second section of each connecting strap extends for the remainder thereof, the lengths of said first and second sections of each connecting strap means varying with movement of the wearer, said first and second connecting strap means extending across the wearer's chest at an angle such that said first and second connecting strap means cross each other in the vicinity of the middle of the wearer's chest; and d. first securing means securing said second end of said first connecting strap means to said second pack strap means, and second securing means securing said second end of said second connecting strap means to said first pack strap means such that said first and second pack strap means and said first and second channeling means tend to be drawn toward each other in response to movement of the wearer, thus maintaining the back pack in place on the wearer's back and tending to prevent movement of the back pack during movement of the wearer.

2. An apparatus of claim 1 wherein the second sections of said first and second connecting strap means are each positioned less than 45° from the horizontal, such that said second sections cross each other at an obtuse angle.

3. An apparatus of claim 1, wherein said securing means include means for removably securing said second ends of said first and second connecting strap means, respectively, to said second and first pack strap means.

4. An apparatus of claim 1, including means for adjusting the length of said first and second connecting strap means.

5. An apparatus of claim 1, including means positioned on each of said second sections for limiting the maximum length of said first sections of said first and second connecting strap means.

6. An apparatus of claim 1, wherein said first and second connecting strap means are secured, respectively, to said first and second pack strap means at a level slightly below the armpits of the wearer.

7. An apparatus of claim 1, wherein said first securing means is positioned at a point along a straight-line distance between said first channeling means and the point at which said second connecting strap means is secured to said second pack strap means, and wherein said second securing means is positioned at a point along a straight-line distance between said second channeling means and the point at which said first connecting strap means is secured to said first pack strap means.

8. A pack strap apparatus for use by a human wearer in combination with back packs or the like, comprising:

a. first and second pack strap means, adapted to be secured at one end thereof to the back pack near the top and toward the opposite sides thereof and to extend over the shoulders of a wearer when the combination of the back pack and said pack strap apparatus is in place;

b. first and second channeling means adapted to be secured to said back pack in the vicinity of opposite sides of said back pack near the bottom thereof, such that said first and second channeling means tend to extend toward each other in the vicinity of the wearer's waist;

c. first and second connecting strap means, each having first and second ends and secured, respectively, at said first ends, to said first and second pack strap means at points slightly below the level of the wearer's armpits, said first and second connecting strap means extending substantially vertically downwardly from said first and second pack strap means and slidably passing through, respectively, said first and second channeling means, the positions of said first and second channeling means, respectively, relative to said first and second connecting strap means defining first and second sections thereof, wherein said first section of each connecting strap extends from said first end thereof to the point there along where each connecting strap passes through its associated channeling means and wherein said second section of each connecting strap extends for the remainder thereof, the lengths of said first and second sections of each connecting strap means varying with movement of the wearer, said first and second connecting strap means extending across the wearer's chest at an angle such that said first and second connecting strap means cross each other in the vicinity of the middle of the wearer's chest;

d. means for adjusting the length of said first and second connecting strap means; and e. first securing means for removably securing said second end of said first connecting strap means to said second pack strap means, and second securing means for removably securing said second end of said second connecting strap means to said first pack strap means, such that said first and second pack strap means and said first and second channeling means tend to be drawn toward each other in response to movement of the wearer, thus maintaining the back pack in place on the wearer's back and tending to prevent movement of the back pack during movement of the wearer.

9. A back pack, comprising:

a. article carrying means adapted to be used on a wearer's back;

b. first and second pack strap means secured to the article carrying means near the top and toward the opposite sides thereof and adapted to extend over the shoulders of a wearer when the back pack is in place;

c. first and second channeling means secured to said article carrying means in the vicinity of the opposite sides and near the bottom thereof, such that said first and second channeling means tend to extend toward each other in the vicinity of the wearer's waist;

d. first and second connecting strap means, each having first and second ends and secured, respectively, at said first ends, to said first and second pack strap means, said first and second connecting strap means extending substantially vertically downwardly from said first and second pack strap means and slidably passing through, respectively, said first and second channeling means, the positions of said first and second channeling means, respectively, relative to said first and second connecting strap means defining first and second sections thereof, wherein said first section of each connecting strap extends from said first end thereof to the point there along where each connecting strap passes through its associated channeling means and wherein said second section of each connecting strap extends for the remainder thereof, the lengths of said first and second sections of each connecting strap means varying with movement of the wearer, said first and second connecting strap means extending across the wearer's chest at an angle such that said first and second connecting strap means cross each other in the vicinity of the middle of the wearer's chest; and e. first securing means securing said second end of said first connecting strap means to said pack strap means, and second securing means securing said second end of said second connecting strap means to said first pack strap means, such that said first and second pack strap means and said first and second channeling means tend to be drawn toward each other in response to movement of the wearer, thus maintaining said article carrying means in place on the wearer's back and tending to prevent movement of said article carrying means during movement of the wearer.

10. An apparatus of claim 9 wherein the second sections of said first and second connecting strap means are each positioned less than 45° from the horizontal, such that said second sections cross each other at an obtuse angle.

11. An apparatus of claim 9, wherein said securing means include means for removably securing the other ends of said first and second connecting strap means, respectively to said second and first pack strap means.

12. An apparatus of claim 9, wherein said first and second connecting strap means are secured, respectively, to said first and second pack strap means at a level slightly below the armpits of the wearer.

* * * * *